US007219869B1

(12) United States Patent
Whittington

(10) Patent No.: US 7,219,869 B1
(45) Date of Patent: May 22, 2007

(54) MULTIPURPOSE PEN AND PENCIL HOLDER

(76) Inventor: Ruben B. Whittington, 1419 Honeyhill Dr., Walnut, CA (US) 91789

( * ) Notice: Subject to any disclaimer, the term of this patent is extended or adjusted under 35 U.S.C. 154(b) by 0 days.

(21) Appl. No.: 10/920,778

(22) Filed: Aug. 18, 2004

(51) Int. Cl.
*A47K 11/08* (2006.01)
*A47F 7/00* (2006.01)

(52) U.S. Cl. ..... 248/311.2; 24/11 CT; 24/11 P; 224/191; 224/247; 248/316.7

(58) Field of Classification Search ..... 248/309.1, 248/311.2, 314, 316.7, 231.81; 206/214, 206/371, 457; 224/219, 251, 274, 191, 247; 24/3.1, 11 CT, 11 P
See application file for complete search history.

(56) References Cited

U.S. PATENT DOCUMENTS 1,102,350 A * 7/1914 Myers ..... 24/11 CT
1,762,103 A * 6/1930 Ferris ..... 211/69.5
2,188,962 A * 2/1940 Sengbusch ..... 222/588
2,423,948 A * 7/1947 Prince ..... 24/11 P
3,096,960 A * 7/1963 Kinney ..... 248/113
D201,479 S 6/1965 Green
4,955,518 A * 9/1990 Parsons et al. ..... 224/247
5,484,066 A 1/1996 Luisi
5,640,743 A * 6/1997 Greene et al. ..... 24/10 R
5,695,162 A * 12/1997 DiCastro ..... 248/231.81
5,868,509 A 2/1999 Crutcher
D441,021 S 4/2001 Roush
D442,638 S 5/2001 Roush
D445,134 S 7/2001 Leeds
6,591,990 B2 7/2003 Lanman et al.
6,644,524 B1 * 11/2003 Garvin ..... 224/411
6,669,031 B1 * 12/2003 Badonic ..... 211/66
D493,072 S * 7/2004 Palmer ..... D7/620
2003/0197104 A1 * 10/2003 Heybl et al. ..... 248/311.2

* cited by examiner

*Primary Examiner*—Carl D. Friedman
*Assistant Examiner*—Tan Le
(74) *Attorney, Agent, or Firm*—Patterson, Thuente, Skaar & Christensen, P.A.

(57) ABSTRACT

A pen or pencil holder that can be mounted on many different surfaces and which can easily be re-located is shown. The holder has two main parts, a trumpet-shaped holder that has a resilient lining, and a base plate that attaches to a surface such as a table, desk, or wall. Six or more different types of base plates are shown, any of which can be selected to suit the desired location of the installation. The base plates shown include styles that can be affixed to the selected support surface with resilient rubber pads, magnets, spring clamps, suction cups, slip-on holders, and hook-and-loop fasteners.

12 Claims, 9 Drawing Sheets

Fig. 21
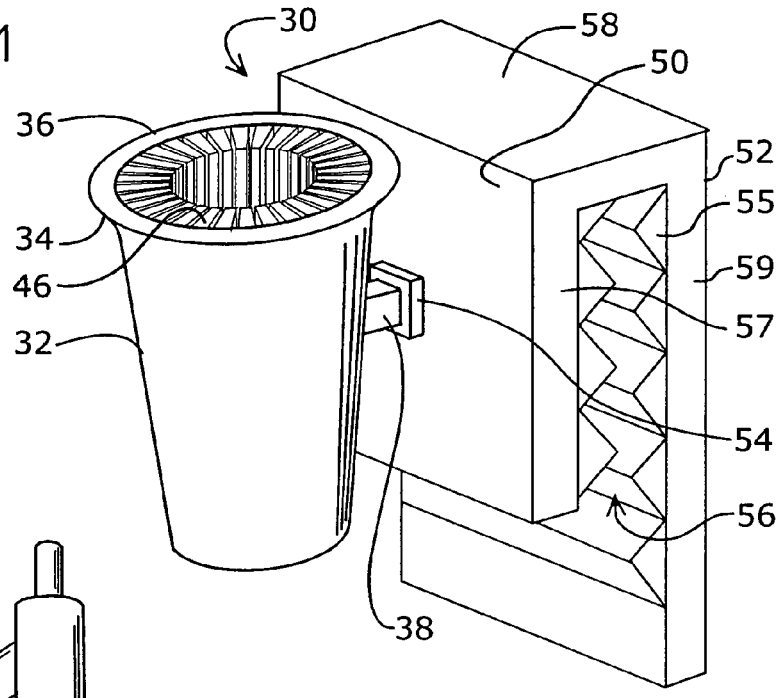
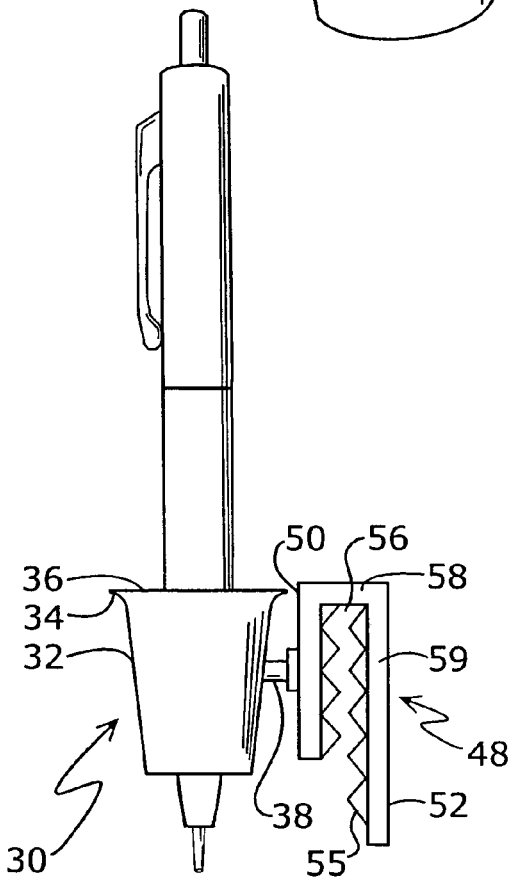
Fig. 22

Fig. 23
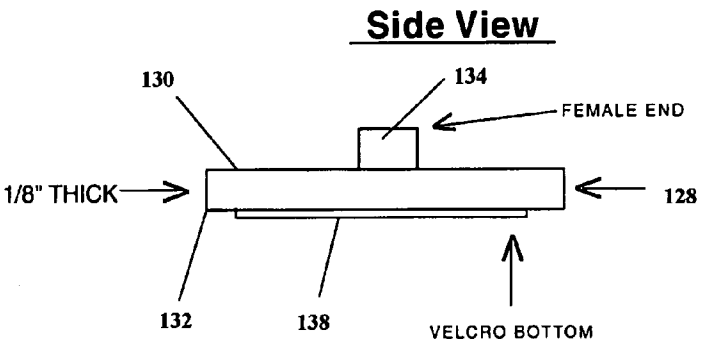
Fig. 24
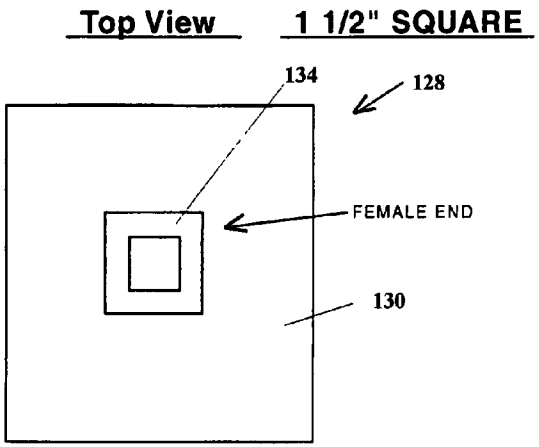
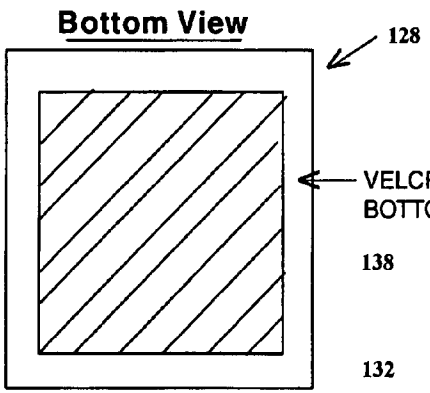
Fig. 25

MULTIPURPOSE PEN AND PENCIL HOLDER

TECHNICAL FIELD

This invention relates generally, but not exclusively, to a holder for markers and writing instruments including pens and pencils. Embodiments according to this disclosure are related more particularly to a novel pen and pencil holder that may be attached to many different surfaces by selecting from a variety of base plates.

DISCLOSURE DOCUMENT REFERENCE

Reference is made to Disclosure Document No. 539110 filed on Sep. 24, 2003, which evidences conception of the invention disclosed and claimed herein.

BACKGROUND OF THE INVENTION

Many workers find that pens, pencils, or other marking instruments are required tools in their occupations. Other individuals need to use specific marking tools at certain locations from time to time. Although many people carry pens, pencils, or the like, upon their persons, in briefcases, purses, backpacks, others do not. It is more practical to locate a pen or pencil at some locations, such as at cashier locations, at bank courtesy desks, by telephones, close to lists, schedules, and near bulletin boards. In other situations, specialized marking tools may be required to properly carry out certain tasks. Some marking tools, special purpose markers, for example, may be very costly, or of little usefulness for tasks other than the procedures for which the instrument was designed. The marking tasks calling for a welder's soapstone, for instance, can seldom be carried out by other types of markers; a soapstone is rarely a good choice for any marking tasks other than those for which it was designed, marking work pieces undergoing metal fabrication.

Drafting pens and pencils may be needed at each drafting table, for example, and nowhere else. Drawing or drafting tables typically consist of a large slanted surface having few if any places to store or place the pens, pencils or other drawing tools. Because drawing or drafting tables are typically slanted, placing a pen, pencil or other implement on the table itself is impractical because the implement will frequently roll or slide off. Individuals often have accustomed themselves to particular arrangements of their drafting tables which makes it desirable to provide that a pen or pencil holder be easy to relocate. Some drawing tool organizers have been introduced, but with only limited acceptance that has developed into limited marketplace success.

Awards presentations are often made of handsome and desirable pen and pencil holders that are suited for decorative display. In other instances, they may be derived from the utmost of utilitarian origins with little or no regard paid to aesthetic considerations. In still other examples, the holder is intended to protect marking instruments from damage resulting from improper storage in addition to presenting the marker conveniently when an individual desires to put the particular object to use.

It may be of particular importance to have a certain type of marking product available at selected locations. Specific highlighter colors may be used to code interoffice mail or other documents. It may be useful to have a specific marking tool at certain locations because products that appear to be similar simply do not work. Marks made on stainless steel using a Sanford® permanent black chisel marker, for example, can remain easily discernable when exposed to temperatures exceeding 500 deg. F.; the marks (after cooling) may be removed using acetone. Many other brands of marker do not have that same combination of characteristics. When it is useful to have that (or any other special-purpose) type of marking tool easily available at the location, efficiency may be improved by providing workers with the particular devices required to apply marks having those characteristics. Doing so can reduce both worker frustration and the amount of time spent searching for the correct marking implement. Furthermore, the amount of rework may also be reduced in those instances where certain marking products are specified based on essential requirements learned through experience with other products which have been shown to be unsuitable.

One of the most common types of pen and pencil holders is a free-standing desk-type holder that is and has a slightly inclined opening into which the point of a pen or pencil may be inserted to hold the pen or pencil in readiness during periods of non-use. Ordinary desk-type pen and pencil holders require a flat horizontal surface upon which to rest. Another type of pen or pencil holder is designed for mounting only upon vertical surfaces. Still another type of pen or pencil holder has a cord to allow the holder to be suspended or hung around a user's neck.

Other workers have developed trays and receptacles adapted for resting on flat, horizontal surfaces such as desk and tabletops. Such devices may be unstable, especially if lightweight or inconveniently over-sized. In addition, they are prone to detachment from the support surface.

Likewise, organizer pouches designed for attachment to vertical surfaces such as walls have been introduced. Workers in the field have not been completely successful in the incorporation of features that yield pen and pencil holders that are both easy to relocate and also mount securely when installed at a desired location.

None of the above-mentioned pen or pencil holders is designed for ready mounting upon a wide variety of surfaces that includes most of the surfaces that are normally found in the working areas of the persons who use pens, pencils, scribes, styluses, crayons, chalk, soapstone, or other types of hand-held elongated markers. For the sake of convenience, the term "marker" will be used hereinafter to refer generally, and not by way of limitation, to marking instruments, pens, pencils, scribes, styluses, crayons, chalk, soapstone, liquid ink markers, and other examples of elongated hand-held devices for making marks.

A device that is simple to use, is of a low cost, is self-storing, requires a minimum amount of time to install, requires a minimum amount of time to remove and effectively holds a pen or pencil regardless of the orientation of the holder would be of considerable value to all individuals who use pens, pencils, or other marking instruments in their within their habitations, workplaces, and in other locations where they carry out their activities.

SUMMARY OF THE INVENTION

The multipurpose pen and pencil holder comprises a trumpet shaped cup, having a male snap-on element and a resilient insert. The trumpet shaped cup is open at the flared end of the cup and receives the resilient insert inside the cup. The resilient insert has a circular opening that is slightly smaller than the diameter of a standard pen or pencil to create an interference fit with the pen or pencil, when the pen or pencil is inserted into the holder, to hold onto the pen or pencil. The first connector portion is permanently attached to the side of the cup, half-way between the top and the bottom of the cup. The preferred embodiment of the base plate is a thin sheet of rectangular shaped material bent to form a J-shaped base plate. Resilient material is attached to the inside of the base plate to allow the base plate to be attached to a clipboard or other thin items. The base plate has a female snap-on element that is centered on the smaller of the two parts that make up the J-shaped base plate and is sized to allow it to receive the first connector portion to connect the multipurpose pen and pencil holder to the base plate.

It is the object of the invention to provide a pen and pencil holder that is effective and simple to use. Another object of the invention is to provide a pen and pencil holder that is easy to manufacture and can be manufactured at a low cost. Another object of the invention is provide a pen and pencil holder that can be attached to a variety of surfaces and effectively holds the pen or pencil regardless of the orientation of the holder. It is yet another object of the invention to provide a pen and pencil holder that can be made in a variety of colors and materials.

Still, another object of the invention is to provide a new and improved pen and pencil holder which provides some of the advantages found in the apparatuses and methods of the prior art thereof, while simultaneously overcoming some of the disadvantages normally associated therewith.

BRIEF DESCRIPTION OF THE DRAWINGS

These and other features, aspects, and advantages of the present invention will become better understood with respect to the following description and accompanying drawings where:

FIG. 21 is a perspective view of the pen or pencil holder of FIG. 19.

FIG. 22 depicts the holder of FIG. 19 in use holding a typical marker.

FIG. 23 is an elevation view of an alternative fourth embodiment of the base plate.

FIG. 24 is a top plan view of the base plate of FIG. 23.

FIG. 25 is a bottom plan view of the base plate of FIG. 23.

DETAILED DESCRIPTION

Figure 1:
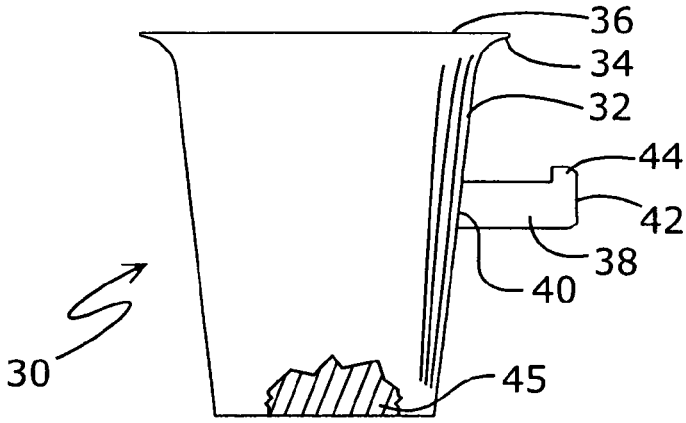
FIG. 1 is a side elevation view of the flared cup pen and pencil-retaining portion of an embodiment of the multipurpose pen and pencil holder.

Referring to the figures of the drawings, wherein like numbers of reference designate like elements throughout the several views, particularly to FIG. 1, there is shown a multiple purpose pen and pencil holder 30 for receiving a pen or a pencil or other marking device and holding the pen or the pencil until it is removed when desired by the user.

FIG. 1 is a side elevation view of a pen and pencil retaining, trumpet-shaped, or tapered, cup 32 having a flared end 34 at the top of the cup 32 which circumscribes an opening 36. The view provides an illustrative embodiment of the pen and pencil holder adapted for holding a single writing instrument. An embodiment of the pen and pencil holder 30 may be fashioned with the cup 32 approximately 1" in height, the flared end 34, or top, approximately ½" in diameter, and the bottom of the cup 32 approximately _" in diameter. The cup 32 can be made of plastic, wood, metal, glass, stone, or other materials as desired.

FIG. 1 shows a first connector portion 38 affixed to the outside of the cup 32 approximately half way between the top and the bottom of the cup 32. The first connector portion is adapted to fit with a mating second connector portion affixed to any of the various base plates. In some configurations the first connector portion 38 affixed to the cup 32 could be made using an L-shaped rectangular member where the top 40 of the L-shape is attached to the cup 32 and the bottom 42 of the L-shape is _" square. The first connector portion 38 could be in the form of a first connector portion having a lip 44 that is perpendicular to the bottom 42 of the L-shape. The lip 44 is 1/32" long.

The first connector portion 38 can be made from plastic, wood or metal or other materials. In such a configuration, the second connector portion would be a female element adapted to retain the first connector portion 38. It is to be understood that there is no practical difference whether the connector portion, male portion, connector receiving portion, female portion, mating element, components are mounted on the support surface or on the cup 32. It is further to be understood that some mating connectors are designed so that all connector linking and mating assembly portions are identical; new connector pairs and assemblies are introduced into the marketplace regularly. Accordingly, the connector element attached to the cup 32 will be referred to as a first connector portion or the male connector portion, and the connector portion that mates with it will be denominated the second connector portion or the female connector portion.

Figure 2:
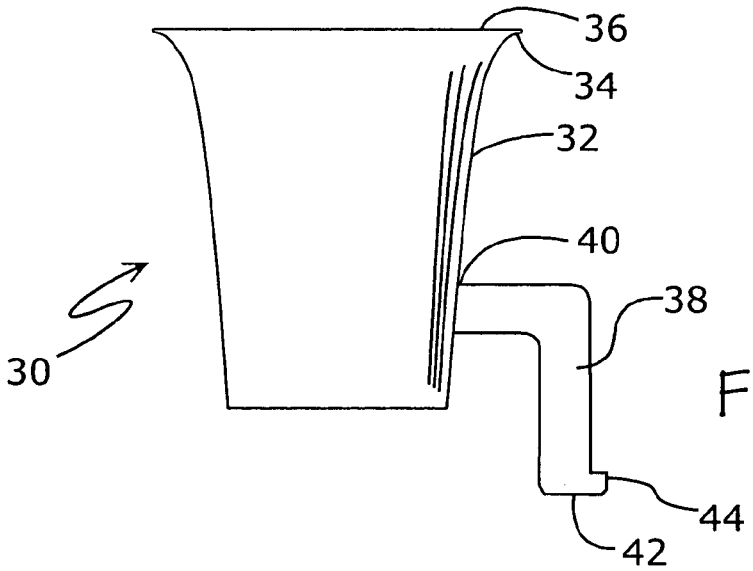
FIG. 2 is an elevation view of an alternative embodiment of the flared cup of FIG. 1 wherein the first connector portion is shown in an optional position.

FIG. 2 shows an elevation view of an alternative embodiment of the flared cup 32 of FIG. 1 wherein the first connector portion 38 is shown in an optional position affixed to the bottom of the cup instead of the side of the cup 32. This configuration may be convenient in situations where the marker holder would be mounted on a wall or an article of furniture.

Figure 3:
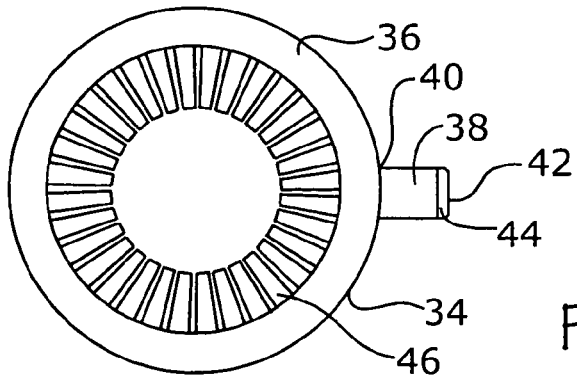
FIG. 3 is a top plan view of the flared cup pen and pencil-retaining portion of FIG. 1.

FIG. 3 is a top plan view of the flared cup pen and pencil retaining portion of FIG. 1 wherein a cylindrical resilient insert 46 is fitted within, and affixed to, the inside of the cup 32. The resilient insert 46 is a tubular cylinder made from a resilient material such as rubber, silicone, urethane, or other elastic polymer or mixture of polymers. The outside diameter of the resilient insert 46 is slightly less than the inside diameter of the cup 32 and is slightly less than 1" long for ready assembly. The inside diameter of the resilient insert 46 is approximately ¼" less than the outside diameter to create a wall thickness of approximately _". The resilient insert 46 is smooth on the outside and ribbed on the inside. The ribs in the interior of the resilient insert 46 allow an interference fit between the resilient insert 46 and the pen, pencil or other marker upon insertion into the holder 30 to effect secure retention of the marker within the holder 30.

Figure 4:
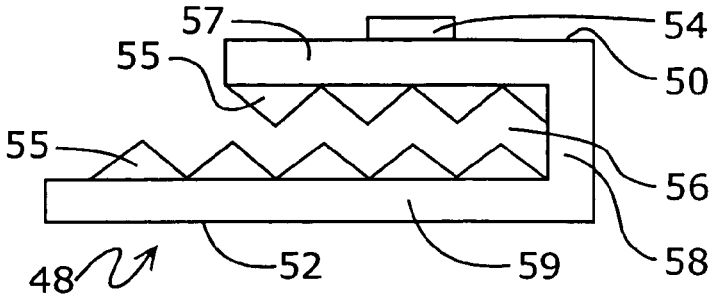
FIG. 4 is a side elevation view of an embodiment of the base plate.

FIG. 4 is a side elevation view of a typical embodiment of the base plate 48 although other embodiments, three representative examples of which follow in this disclosure, are adapted to function optimally in specific installations. It may be manufactured from any convenient material without departing from this disclosure because the selection of materials may be varied to suit the intended application. Steel, aluminum, other metals, sheet polymer resin, molded polymer resin, extruded metal or polymer resin, wood, ceramic, or other materials without limitation may be selected and incorporated into the base plate 48.

It is anticipated that one ordinarily desirable method of manufacturing the base plate 48 will be to form it from a _" thick sheet of rectangle of the selected material, such as plastic or metal, that is formed into the shape of a "J". Vacuum forming, injection molding, and extrusion may be suitable techniques for making the base plate 48 from various polymer compounds. Brake press, extrusion, roll forming, or die-casting may be useful in making the base plate 48 from metals. Sonic welding of polymer resin sheet stock and spot, resistance, e-beam, or any of the other commercially available procedures for welding or joining metal and other sheet stock materials may be employed to make the apparatus 30 by assembly of discrete components that may have differing thickness, resiliency, or other properties. It is probable that practical fabrication using metal stock would require use of material substantially thinner than _".

The base plate 48 has a base plate top 50, a base plate bottom 52, a second connector portion (female snap-on element) 54 positioned on the base plate top 50. An optional anti-skid layer 55 may be affixed to the inner faces of the base plate top 50 and bottom 52. The base plate 48 may be described as having the shape of a "J" channel in cross-section which has a throat 56 for receiving a generally planar mounting surface at the location where it is desired to install, or mount, 1 the multiple purpose pen and pencil holder 30. A first leg 57 of the "J" bend may be shorter, longer, or equal to the length of the opposite leg of the "J" channel that forms the body of the base plate 48. Embodiments having both legs of equal length, the cross-section would have the shape of a "C" channel. It is equivalent, however for the anti-skid layer to be applied to neither, one, or both legs of the channel. It may also be possible to make the base plate 48 or portions of it from resilient materials or from materials having properties that render an anti-skid layer 55 unnecessary.

FIG. 4, may be used to appreciate an illustrative example of the making of the base plate 48. shows that a rectangular piece of _" thick polymer sheet stock in a size of approximately 2¾" by 1¼" may be used to make a base plate top 50 approximately 1" by 1¼" that forms a first, shorter leg of a resilient "J" bend 57 by being affixed to one edge of a web 58, that is approximately ¼ in length. To the other edge of the web 58 there is affixed a second leg 59 which is formed by a base plate bottom 52 that is approximately 1½ by 1¼". In this configuration, the height of the web 58 determines the thickness of the mounting surface that may be retained within the throat 56. The web 58 may be made of a resilient material so that it functions as a biasing element 60. A mounting surface such as a clipboard may be received within the throat 56 so that the base plate 48 may be held securely by operation of the biasing element 60 which urges the base plate top 50 and bottom 52 each toward the other to retain the mounting surface within the base plate 48.

The dimensions given above and elsewhere in this disclosure are provided only to facilitate understanding of the making of what is believed to be practical and elegant embodiment and are not to be construed as limiting the scope of the claims. It is to be understood that larger or smaller pen and pencil holders 30 may be made from this disclosure whenever desired for applications such as holding larger pens and pencils, holding a multiplicity of markers, or for holding smaller marking instruments.

Figure 7:
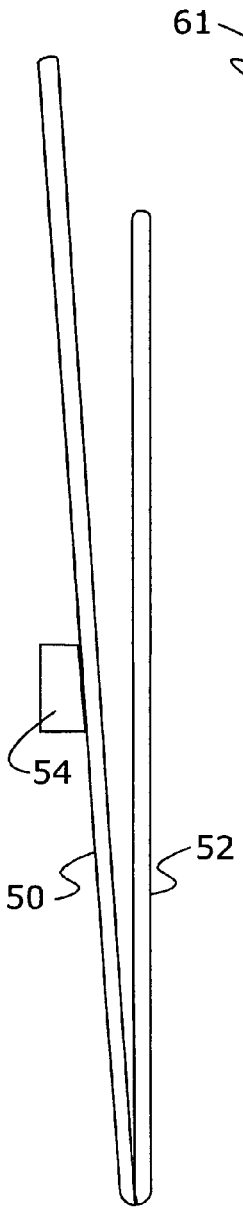
FIG. 7 is an elevation view of an alternative second embodiment of the base plate.

The bottom of the J shape where the base plate top 50 is connected to the base plate bottom 52 may be ½ long. As shown in FIG. 7, the second connector portion 54 is made from a thin sheet of material, such as wood, plastic or metal, having a rectilinear shape with the outside sides being ¼" long and the inside sides being 5/32" long.

FIG. 4 illustrates the thickness of the second connector portion 54 is 3/16". These dimensions allow the second connector portion 54 to receive the first connector portion 38. This allows the base plate 48 to support the cup 32. A base plate anti-skid layer 55 may be attached to the inside of the J-shape base plate 48. The base plate anti-skid gripping layer 55 may be fashioned from sheet stock of resilient elastomer material, such as rubber, vinyl, urethane, silicone or gel cut to shapes that correspond to the opposed, inner faces of the base plate top 50 and the base plate bottom 52. The base plate anti-skid gripping layer 55 may be made so that it smooth on one side and ribbed on the other side as an option. The smooth side of the base plate anti-skid gripping layer 55 is attached to the base plate 48. The ribbed side of the base plate anti-skid gripping layer 55 could be used to create an interference fit with a clip board or other such thin surface in order to hold the multiple purpose pen and pencil holder 30 to the desired object.

Figure 5:
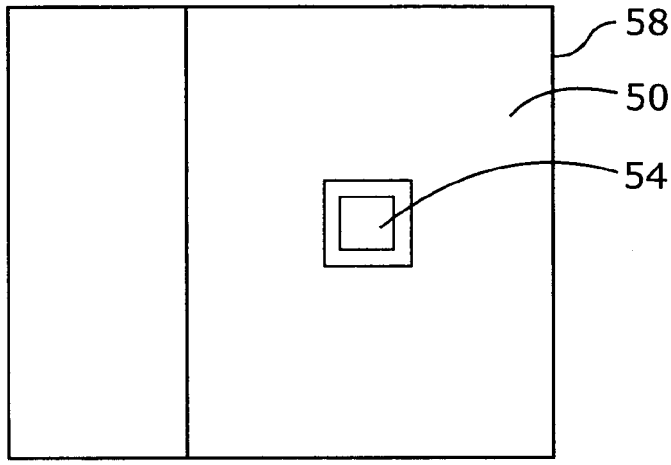
FIG. 5 is a top plan view of the base plate depicted in FIG. 4.

FIG. 5 is a top plan view of the standard base plate depicted in FIG. 4. A second connector portion 54 is affixed to the top surface 50 of the base plate 48.

Figure 6:
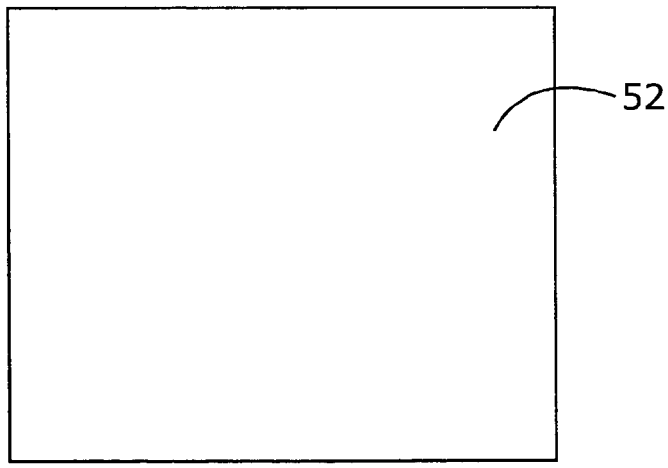
FIG. 6 is a bottom plan view of the base plate depicted in FIG. 4.

FIG. 6 is a bottom plan view of the base plate 48 depicted in FIG. 4.

FIG. 7 is an elevation view of an alternative second embodiment, or second style, of the base plate 61 for receiving first connector portion 38 instead of the standard base plate 48. This second style of base plate 61 comprises a base plate top 50, a base plate bottom 52 and a second connector portion 54. This embodiment of the base plate top 50 is made from a 1/16" thick sheet of flexible material, such as wood, plastic or metal, that is 3½" long, ½" wide at one end and _" wide at the opposite end. The base plate bottom 52 is made from a 1/16" thick sheet of flexible material, such as wood, plastic or metal, approximately 3" long, ¼' wide at one end and 3/16" wide at the opposite end. The bottom of the base plate top 50, at the ½" wide end, is attached to the top of the base plate bottom 52, at the ¼" wide end, to form a slide-on clip. This second style of base plate 61 is to slide on to thin items such as clipboards.

Figure 8:
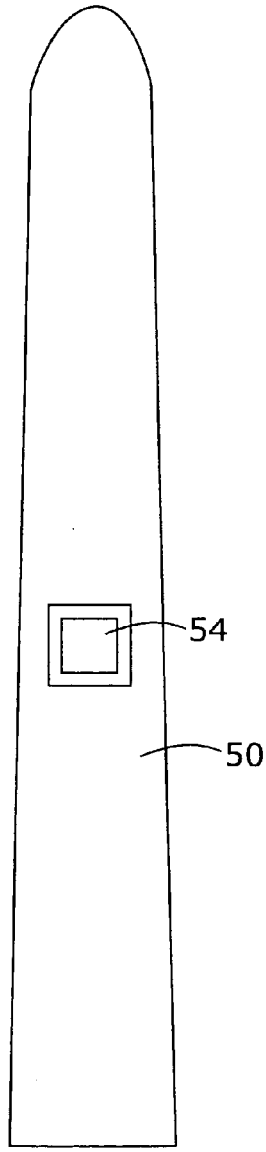
FIG. 8 is a top plan view of the base plate depicted in FIG. 7.

FIG. 8 is a top plan view of the alternative base plate depicted in FIG. 7 which shows a second connector portion 54 attached to the base plate top 50 so that the second connector portion 54 receives the first connector portion 36 to connect the second style of base plate 61 to the cup 32. This second style of base plate 61 embodiment can also include a base plate anti-skid gripping layer 55, not shown, to help prevent this second style of base plate 61 from slipping off the support surface.

Figure 9:
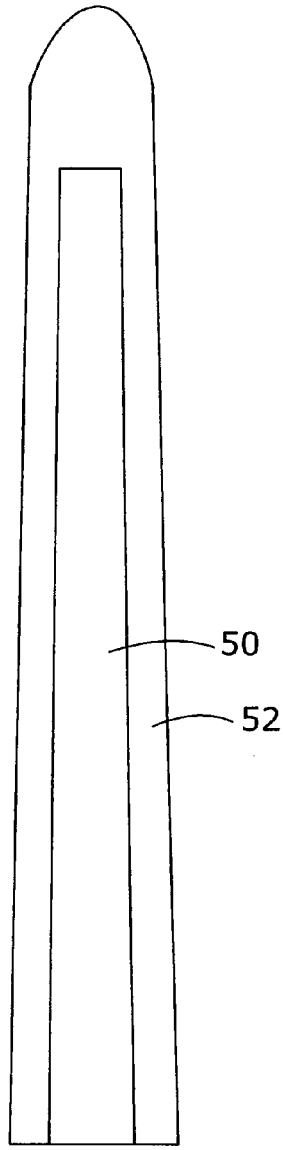
FIG. 9 is a bottom plan view of the base plate depicted in FIG. 7.

FIG. 9 is a bottom plan view of the alternative base plate embodiment depicted in FIG. 7 that shows the relative positions of the base plate top 50 and base plate bottom 52 in this alternative configuration.

Figure 10:
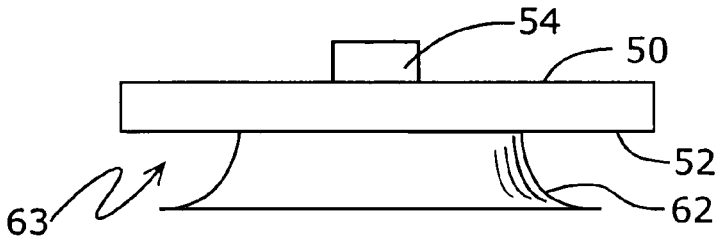
FIG. 10 is an elevation view of an alternative third embodiment of the base plate.

FIG. 10 is an elevation view of a suction cup 62 mounted alternative third embodiment, or third style, of base plate 63 that may, in some installations, be selected in place of the standard base plate 48. It may be made from sheet material, such as wood, plastic or metal that is approximately _" thick. It may be made with a square plan view, or in another shape, such as circular to match a suction cup 62 affixed to the base plate bottom 52. This third style of base plate 63 allows for easy connection and removal of the holder 30 from a wide variety of surfaces, especially smooth surfaces such as glass, without harming these surfaces.

Figure 11:
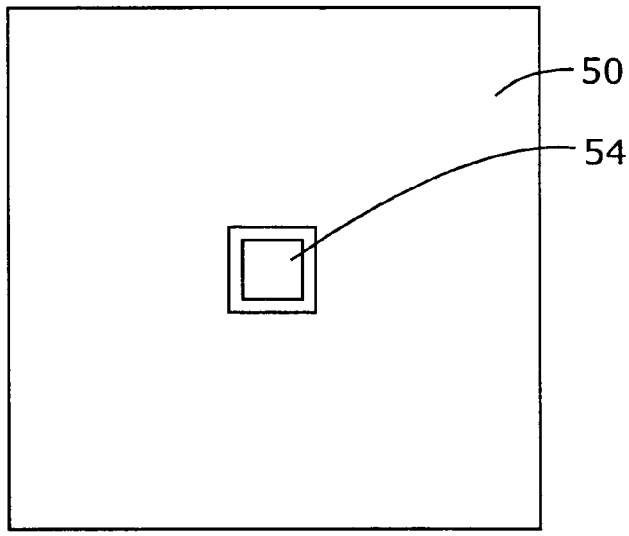
FIG. 11 is a top plan view of the base plate depicted in FIG. 10.
Figure 12:
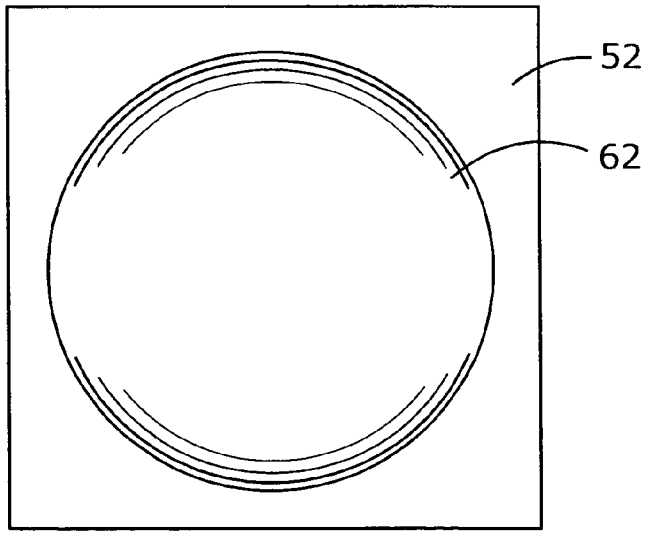
FIG. 12 is a bottom plan view of the base plate depicted in FIG. 10.

FIG. 11 is a top plan view of the alternative base plate depicted in FIG. 10. In this configuration, the second connector portion 54 is visible and centered on the base plate top 50. FIG. 12 is a bottom plan view of the embodiment of the base plate depicted in FIG. 10. The suction cup 62 affixed to the base plate bottom 52 is visible in this figure. FIGS. 11 and 12 show a third embodiment of the base plate 28. As shown in FIG. 11, this embodiment of the base plate 28 is made from two ⅛" thick sheets of material, such as wood, plastic or metal, that are square shaped, one sheet comprising a base plate top 30 and the other sheet comprising a base plate bottom 32. As shown in FIGS. 11 and 12, a female snap-on element 34 is attached to the base plate top 30.

As indicated above, the female snap-on element 34 receives the male snap-on element 16 to connect the base plate to the cup 12. The base plate top 30 and the base plate bottom 32 are attached to a bias element 40, such as a spring, such that the bias element 40 cause one end of the base plate top 30 to come in contact with one end of the base plate bottom 32 to create a clothespin type clip. This embodiment of the base plate 28 attaches the holder to large variety of surfaces by clipping the base plate 28 to the surfaces. This embodiment of the base plate 28 can also include a base plate resilient element 36, not shown, to help prevent this base plate 28 from slipping off the surface.

Figure 13:
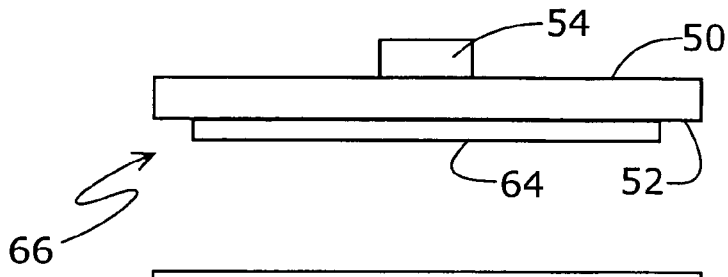
FIG. 13 is an elevation view of an alternative fourth embodiment of the base plate.

FIG. 13 is an elevation view of the alternative fourth embodiment, secured in position on the mounting surface by a magnet 64, affixed to the base plate 66. Unlike the standard base plate 48, this embodiment is readily mounted on thick surfaces or at a position removed from the edge of the mounting surface.

Figure 14:
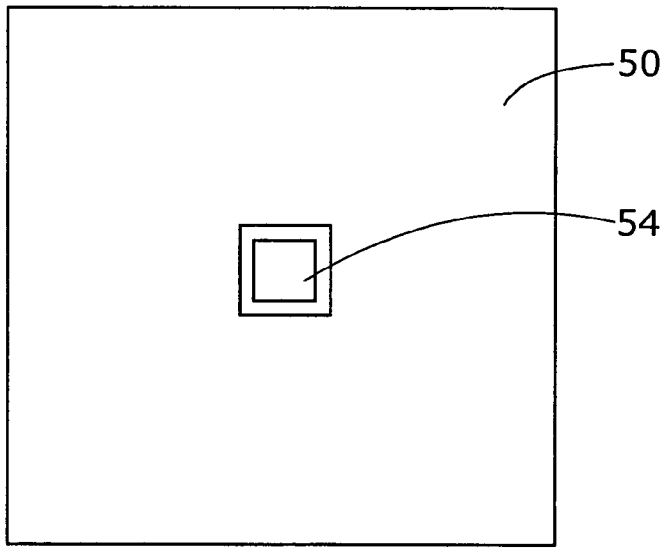
FIG. 14 is a top plan view of the base plate of FIG. 13.

FIG. 14 is a top plan view of the embodiment of the base plate of FIG. 13.

Figure 15:
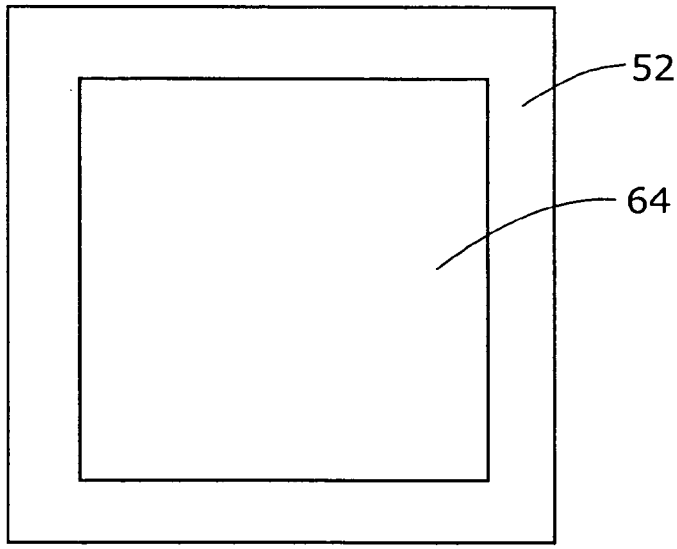
FIG. 15 is a bottom plan view of the base plate of FIG. 13.

FIG. 15 is a bottom plan view of the base plate 66 of FIG. 13. This fourth style of base plate 66 may be made from _" thick sheet material such as woods, plastic, or metal, to provide a base plate top 50 and a base plate bottom 52. A second connector portion 54 is attached to the base plate top 50 to receive the first connector portion 38 so as to unite the base plate 66 and the cup 32 to complete the pen and pencil holder 30. The magnet 64 may be attached to the base plate bottom 52 using adhesive, thermal welding, integral inclusion of magnetic material within the sheet stock from which the base plate 66 is made. This fourth style of base plate 66 allows for easy connection and removal of the holder 30 from a wide variety of metal surfaces, such as a metal desk, refrigerator, golf cart, building structural components, or metal storage cabinet with little risk that mounting surface would be damaged.

Figure 16:
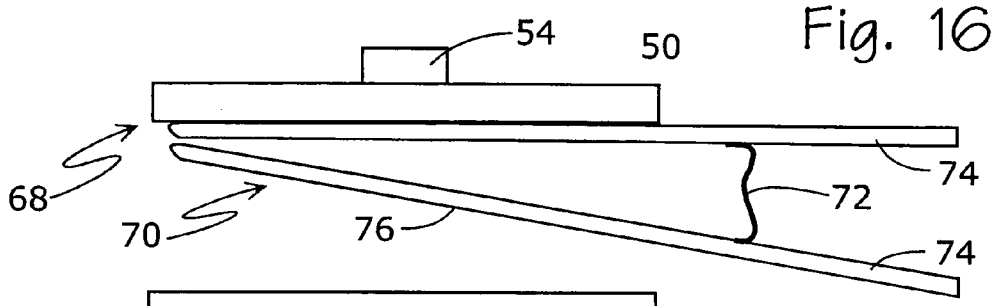
FIG. 16 is an elevation view of an alternative fifth embodiment of the base plate.

FIG. 16 shows a elevation view of an alternative fifth embodiment of the base plate 68 which includes spring clips or clamps 70 that may be comparable to spring clothes pins or spring binder clips used in offices to secure loose document pages. Many clamp configurations will allow for convenient connection and removal of the marker holder 30 from a wide variety of surfaces. An elastic biasing element 72, such as a metal, wood, or polymer spring may be manually flexed using a clamp handle 74 to separate the clamp leg 76 from the base plate bottom.

The biasing element 72 may readily comprised of a torsion coil spring or a leaf spring. The base plate 68 may be affixed to a support surface by positioning the support surface between the base plate bottom 52 and the clamp leg 76 and releasing the clamp handle 74.

This holder 30 is secured in position on the mounting surface by a spring clamp 70, affixed to the base plate 68. Unlike the standard base plate 48, this embodiment is readily mounted on thick surfaces or at a position removed from the edge of the mounting surface. Such an alternative embodiment modifying the standard style of base plate 48 could readily attach the holder 30 to an extensive variety of surfaces including drafting tables, desks, and the like. Such an embodiment of the base plate 68 can also include a base plate anti-skid gripping layer, coating, film, foam, gel, to reduce any propensity of the assembly to slip.

Figure 17:
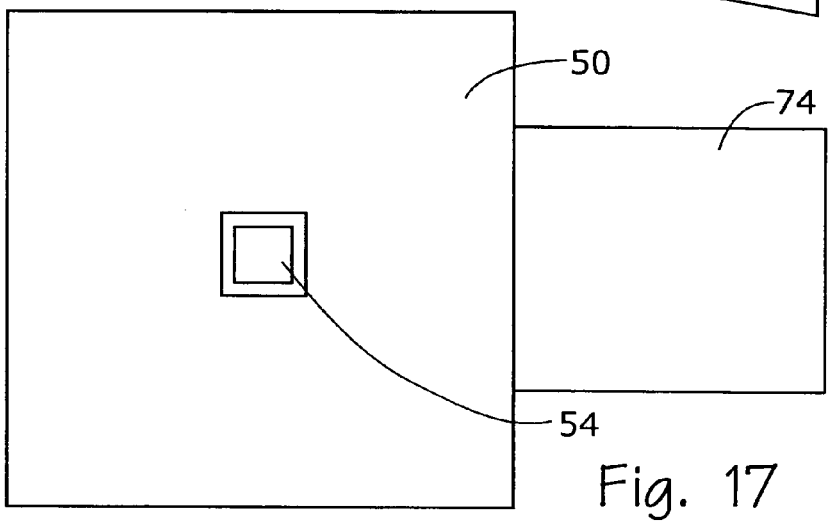
FIG. 17 is a top plan view of the base plate of FIG. 16.

FIG. 17 is a top plan view of the base plate 68 of FIG. 16.

Figure 18:
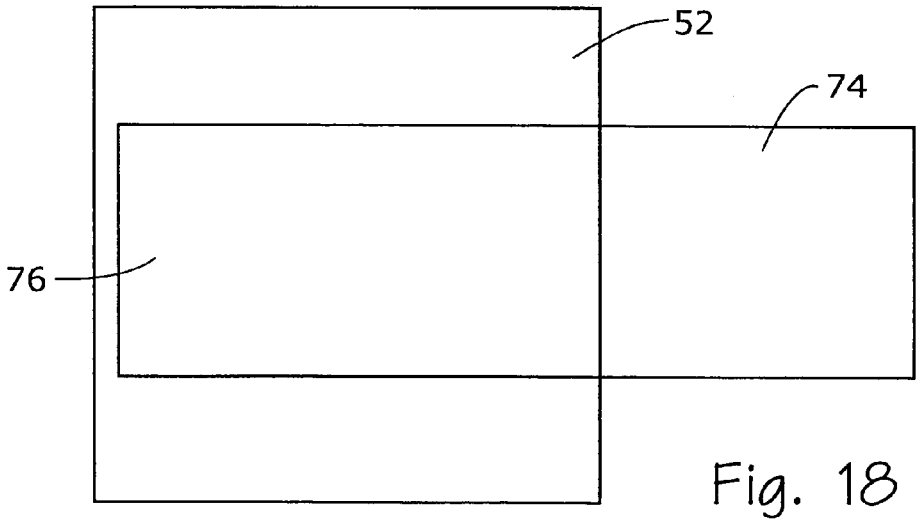
FIG. 18 is a bottom plan view of the base plate of FIG. 16.

FIG. 18 is a bottom plan view of the base plate 68 of FIG. 16.

Figure 19:
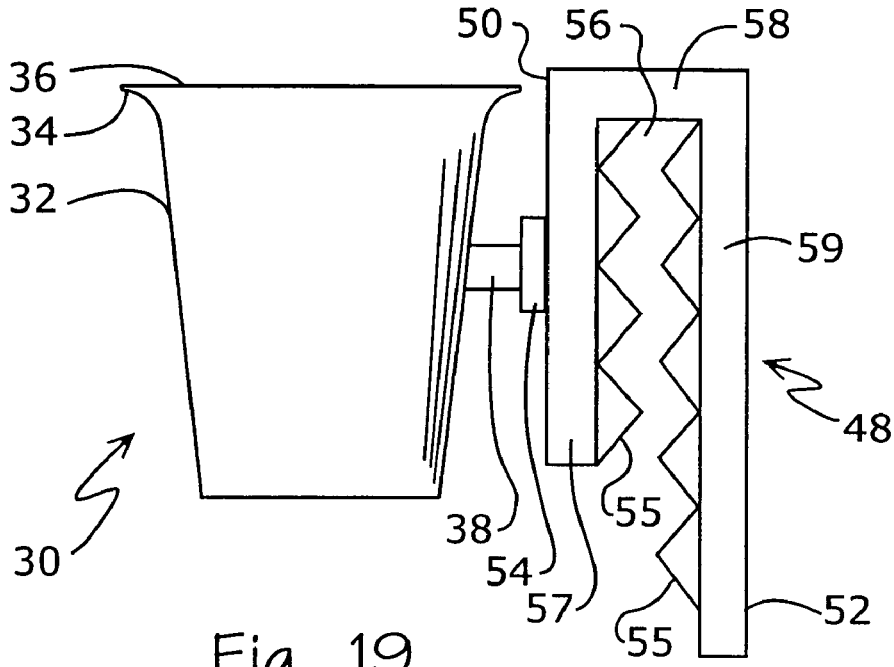
FIG. 19 is a side elevation view of the holder of FIG. 1.
Figure 20:
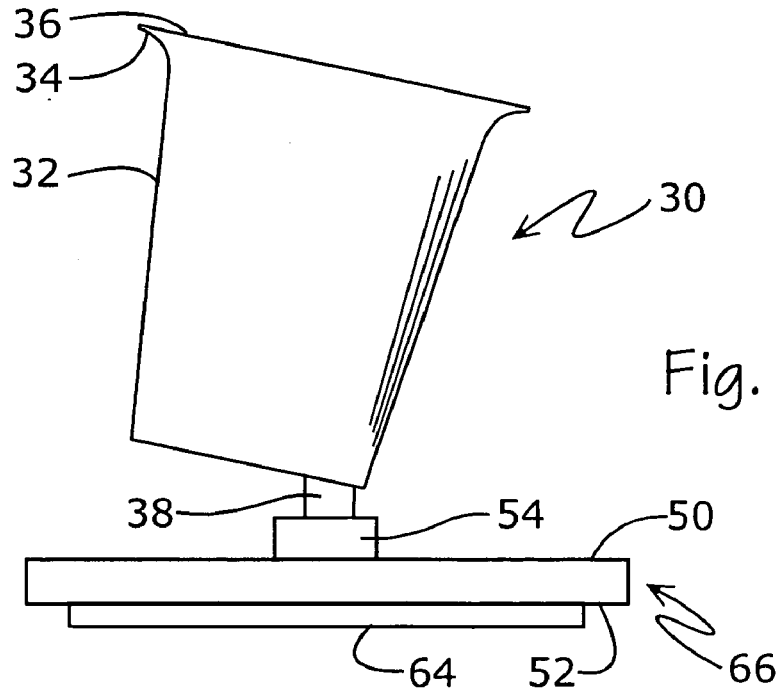
FIG. 20 is a side elevation view of the holder of FIG. 2.

FIG. 19 and FIG. 20 depict side elevation views of the entire holder 30 using the cup of FIG. 1 and FIG. 2, respectively.

FIG. 21 is an isometric perspective view of the pen or pencil holder 30 of FIG. 19.

FIG. 22 depicts the pen or pencil holder 30 of FIG. 19 in use holding a marker typical of the devices the holder 30 is designed to receive, a ballpoint pen.

Another specific equivalent technique for securing the base plate 48 to a support surface may be implemented by affixing one part of a hook-and-loop fastener such as Velcro® to the base plate bottom 52, and affixing the corresponding component of the hook-and-loop fastener to the selected support surface. This method is convenient because hook and loop fasteners are commercially available with pressure sensitive adhesive for use in such a configuration.

Other provisions for securing the base plate 48 to a support surface may be implemented without departing from the scope of the disclosure. For example, adhesives, mechanical fasteners such as nails, screws, and rivets, spring clamps, screw clamps, and other commercially available fasteners, and their equivalents may be used to support, mount, secure, or affix a base plate that is similar to the base plate 48. By being adapted for accepting any such particular fastener or other means for affixing the base plate, such base plate embodiments are equivalent to those described in greater detail in this disclosure.

Referring now to FIGS. 23-25, FIG. 23 is an elevation view of an alternative fourth embodiment of the base plate; FIG. 24 is a top plan view of the base plate of FIG. 23; and FIG. 25 is a bottom plan view of the base plate of FIG. 23. A second embodiment of the base plate 128 is shown in FIGS. 23-25. As shown in FIG. 23, this embodiment of the base plate 128 is made from a ⅛" thick sheet of material, such as wood, plastic or metal, that is square shaped having a base plate top 130 and a base plate bottom 132. As shown in FIGS. 23 and 24, a female snap-on element 134 is attached to the base plate top 130. As indicated above, the female snap-on element 134 receives the male snap-on element 38 to connect the base plate to the cup 32. As shown in FIGS. 23 and 25 one part of a Velcro® fastener 138 is attached to the base plate bottom 132. The second part of the Velcro® fastener 138 is attached to the surface where the multiple purpose pen and pencil holder 30 will be attached thereto. This embodiment of the base plate 128 allows for easy connection and removal of the holder 30 from a wide variety of surfaces.

Changes and modifications in the specifically described embodiments can be carried out without departing from the scope of the invention, which is intended to be limited only by the scope of the appended claims.

The invention claimed is:

1. A pen, pencil and other marking instrument holder adapted for attachment to a variety of support surfaces via a plurality of selectable base plates comprising:

a base plate having a base plate top, a second connector portion affixed to the base plate top, a base plate bottom, means for affixing the base plate to a support surface said means having a resilient biasing member operably joining the base plate top and the base plate bottom so as to define a receiving throat, the resilient biasing member urging the base plate top and the base plate bottom together to retain a support surface within the receiving throat, a tapered cup circumscribing an opening connecting both ends of the cup, the cup having a resilient insert affixed within the opening, the resilient insert having a plurality of spaced apart longitudinal ribs projecting into the opening and extending along an opening length, said space apart longitudinal ribs providing an interference fit along the opening length for receiving and retaining a marking instrument, and a first connector portion adapted for mating with the second connector portion.

2. The pen, pencil and other marking instrument holder defined in claim 1 wherein the means for affixing comprises a fastener attached to the base plate bottom surface.

3. The pen, pencil and other marking instrument holder defined in claim 1 wherein the base plate is formed of two layers of elongated, thin resilient sheet material adapted for receiving and retaining a support surface comprised of thin sheet material.

4. The pen, pencil and other marling instrument holder defined in claim 1 wherein a resilient suction cup is affixed to the base plate bottom surface.

5. The pen, pencil and other marking instrument holder defined in claim 1 wherein a magnetic layer is affixed to the base plate bottom surface.

6. The pen, pencil and other marking instrument holder defined in claim 1 wherein a support surface engaging spring clamp is affixed to the base plate bottom surface.

7. The pen, pencil and other marking instrument holder defined in claim 1, wherein the means for affixing comprises a resilient web operably joining the base plate top and the base plate bottom so as to define a receiving throat, the resilient web urging the base plate top and the base plate bottom together to retain a support surface within the receiving throat.

8. The pen, pencil and other marking instrument holder defined in claim 7 wherein the base plate includes the base plate top, base plate bottom and resilient web arranged in a "J" channel configuration.

9. The pen, pencil and other marking instrument holder defined in claim 8 wherein anti-skid material is affixed within the "J" channel configuration, the anti-skid material being positioned along inner-surfaces of the base plate top and base plate bottom.

10. The pen, pencil and other marking instrument holder defined in claim 1, wherein the resilient insert is formed of a resilient material selected from the group consisting essentially of: rubber, silicone, urethane, an elastic polymer, an elastic copolymer and combinations thereof.

11. The pen, pencil and other marking instrument holder defined in claim 1, wherein the cup comprises a flared cup having a flared end and a non-flared end.

12. The pen, pencil and other marking instrument holder defined in claim 1, wherein the opening has an opening diameter exceeding a marking instrument diameter.

* * * * *